United States Patent [19]

Dearden et al.

[11] Patent Number: 4,640,343

[45] Date of Patent: Feb. 3, 1987

[54] TUBE-IN-SHELL HEAT EXCHANGERS

[75] Inventors: Guy L. Dearden, Rochdale; Owen Hayden, Bolton, both of England

[73] Assignee: National Nuclear Corporation Limited, London, England

[21] Appl. No.: 649,669

[22] Filed: Sep. 12, 1984

[30] Foreign Application Priority Data

Sep. 28, 1983 [GB] United Kingdom ..... 8325948

[51] Int. Cl.[4] ..... F28F 11/00

[52] U.S. Cl. ..... 165/70; 285/226; 285/93

[58] Field of Search ..... 165/70, 81, 83; 285/226, 93

[56] References Cited

U.S. PATENT DOCUMENTS

| | | | |
|---|---|---|---|
| 2,152,266 | 3/1939 | McNeal | 165/83 |
| 2,658,728 | 11/1953 | Evans, Jr. | 165/70 X |
| 4,171,014 | 10/1979 | Straub | 165/70 X |
| 4,237,968 | 12/1980 | Duke | 165/70 |
| 4,249,593 | 2/1981 | Bieberback et al. | 165/70 |

FOREIGN PATENT DOCUMENTS

| | | | |
|---|---|---|---|
| 13601 | 3/1956 | Fed. Rep. of Germany | 165/83 |
| 650058 | 1/1929 | France | 165/70 |
| 984373 | 2/1965 | United Kingdom | 165/83 |
| 664010 | 5/1979 | U.S.S.R. | 165/83 |

*Primary Examiner*—William R. Cline
*Assistant Examiner*—Peggy A. Neils
*Attorney, Agent, or Firm*—William R. Hinds

[57] ABSTRACT

A tube-in-shell heat exchanger has double sealing joints between the tubes and a tube plate of the heat exchanger constituted by the provision of a secondary tube plate spaced from the normal tube plate and through which each tube extends with sealing in addition to the normal tube to tube plate sealing joints, there being a bellows enveloping the tubes and sealed to both the normal and the secondary tube plates. The space between these tube plates can be monitored for leakage.

12 Claims, 2 Drawing Figures

TUBE-IN-SHELL HEAT EXCHANGERS

BACKGROUND OF THE INVENTION

This invention relates to tube-in-shell heat exchangers.

It relates in particular to expedients to be provided for achieving a greater integrity of joint between the tubes of the heat exchanger and each tube plate (also known as tube sheets) which, with the casing of the heat exchanger, provides the shell through which fluid for contact with the exterior of the heat exchanger tubes is conducted, the other fluid for heat exchange being caused to flow through the tubes. This type of heat exchanger has many applications, one of which is as a steam generator for a fast nuclear reactor cooled by liquid metal, the liquid metal in this case being the fluid in the shell, and the water/steam being the fluid within the tubes.

In the particular application referred to, there have been problems concerned with the integrity of the joint between the heat exchanger tubes and the tube plate. The problems are compounded by the fact that in the said application, for a typical design of plant for a large power station, there are likely to be hundreds of tube to tube plate joints for every steam generator, and if one of the joints should leak, the reactor will have to be shut down so that the leaking joint can be isolated by blocking off or sleeving the offending tube, this being necessary to avoid the consequences of a water/liquid metal chemical reaction. One of the expedients previously proposed (see British Patent No 785,862) for increased integrity is to arrange a gas space between the liquid metal in the shell and the interior surface of the tube plates closing the shell, thereby avoiding welds between the tubes and the relevant tube plate being immersed in hot liquid metal.

FEATURES AND ASPECTS OF THE INVENTION

According to the invention, we provide, in or for a tube-in-shell heat exchanger, double sealing joints between the tubes and a tube plate manifest by secondary tube plate adjacent to but spaced from the normal tube plate, each tube extending through the secondary tube plate and being sealed thereto as well as being sealingly secured to the normal tube plate, and the secondary tube plate being sealed in its spaced position by a bellows sealingly secured to both the normal and the secondary tube plates and disposed so as to envelope the said tubes.

The space between the normal and secondary tube plates can be employed for monitoring for leakage.

The joints between the tubes and the normal tube plate can be by explosive welding or by welding of each tube to a pintle depending from each bore in the tube plate. The joints between the tubes and the secondary tube plate can be by brazing, with or without the provision of pintles provided on the outer surface of the secondary tube plate. A feature of the invention is that the secondary tube plate is not rigidly connected to the main tube plate (as in the heat exchanger disclosed in British Pat. No 785,862). Thus, the bellows not only serves to seal the space between the main and secondary tube plates but also allows some degree of relative movement to take place between the tube plates by virtue of bellows deflection. In this way, axial loading of the tube-to-plate joints in response to thermal shocks causing differential expansion or contraction is substantially reduced.

DESCRIPTION OF THE DRAWINGS

A constructional example embodying the invention will now be described with reference to the accompanying diagrammatic drawings wherein.

DESCRIPTION OF THE EXEMPLARY EMBODIMENT

Figure 1:
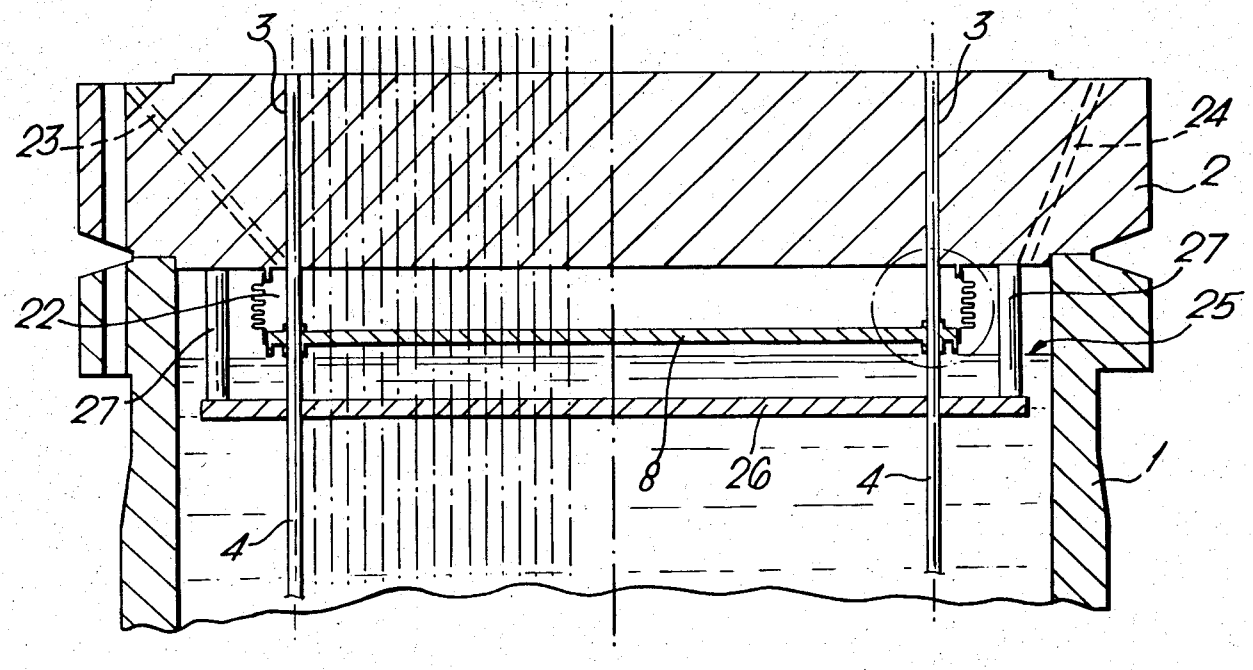
FIG. 1 is a side view in medial section.
Figure 2:
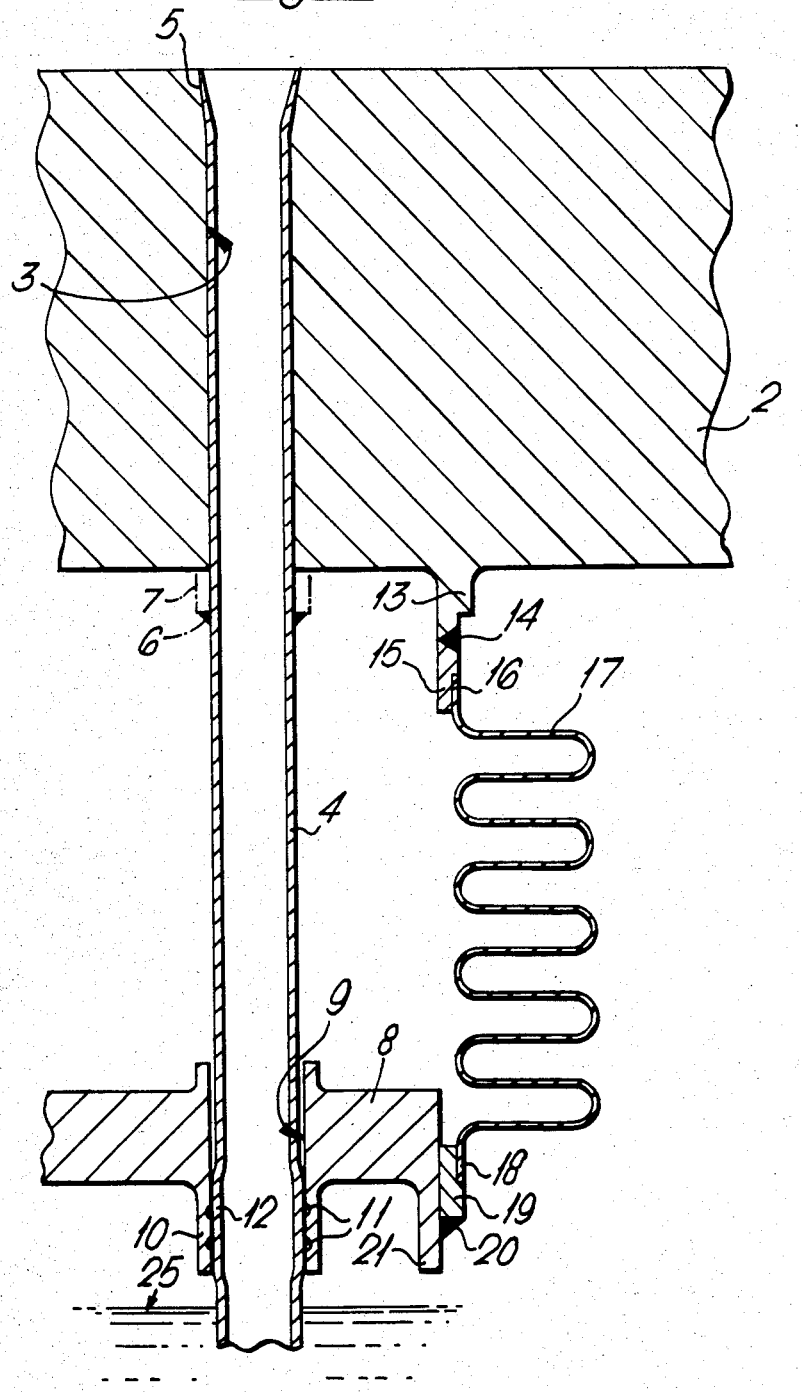
FIG. 2 is a detail of that part of FIG. 1 which is circled.

Referring to the drawings, in the construction illustrated therein, we provide a tube-in-shell heat exchanger which is of U-form, the upper end of one limb only being shown in FIG. 1, the upper end of the other limb being similar. The heat exchanger has a casing 1 secured by welding to a tube plate 2 which has a plurality, for example over 900, of bores 3 (2 only of which are shown but the axis of others being indicated in dot-and-dash lines), each bore containing a tube 4 of the heat exchanger, each tube 4 being sealingly secured to the tube plate 2, for example by explosive welding at the region designated 5 in FIG. 2, or alternatively by fusion welding 6 to a pintle 7 provided at the lower surface of the tube plate 2 and indicated in dot-and-dash lines in FIG. 2.

A secondary tube plate 8 is disposed beneath the normal tube plate 2 and spaced significantly therefrom, and having bores 9 corresponding with the bores 3 of tube plate 2. Each tube 4 extends through a bore 9 and is secured to the secondary tube plate 8 by brazing. Advantageously, there is a pintle 10 depending from the tube plate 8 and continuing each bore 9 so as to facilitate the production of the brazed sealing joints. These are indicated by the regions of brazed metal 11 and the expanded part 12 of the relevant tube 4. The normal tube plate 2 has a depending flange 13 of sufficient diameter to embrace all the tubes 4 associated with the tube plate 2. Secured by a seam weld 14 to the flange 13 is a ring 15 itself secured by welding at 16 to a bellows 17 which extends downwardly sufficiently to enclose the said space beneath the tube plate and above the secondary tube plate 8, being secured by welding at 18 to a ring 19 itself welded at 20 to a depending rim 21 of the secondary tube plate 8.

The space between the two tube plates, designated 22, is conveniently occupied by a clean inert gas such as Argon and an inclined bore 23 serves not only for maintaining the space 22 at a slight positive pressure but also for enabling sampling of the gas in space 22 for testing it for a change of composition which would indicate that there was a defect in one of the sealing joints, it being inconceivable that liquid metal could penetrate into this region other than by catastrophic failure. Further inclined holes 24 extend through the tube plate 2 and communicate with the space outside the bellows but within the casing and above the liquid metal 4, indicated by reference 25 in FIG. 1.

To assist in avoiding stressing of the brazed joints between the tube 4 and the secondary tube plate 8, a tube spacer plate 26 can be provided beneath the secondary tube plate 8 and secured to the tube plate 2 by depending columns 27.

It is considered that the invention provides greater reliability and a greater safety margin by isolating the normal tube to tube plate joints from the hazardous liquid metal environment by means of the provision of the secondary tube plate.

Further alternatives for the joining of the tubes to the (main) tube plate include mechanical seals, either of a kind which relies on expansion of the tubes within the respective tube plate bores, the expansion being by either explosive, hydraulic or mechanical means, or of a kind which employs a screwed compression-type coupling.

What is claimed is:

1. A tube-in-shell heat exchanger with double sealing joints between the tubes and a tube plate, comprising a secondary tube plate within the shell and adjacent to but spaced from the normal tube plate, each tube extending through the secondary tube plate and being sealingly secured thereto as well as being sealingly secured to the normal tube plate, and the secondary tube plate being held and sealed in its spaced position by a bellows of substantially thinner and more flexible material than said secondary tube plate sealingly secured to both the normal and the secondary tube plates and disposed so as to envelope the said tubes, with the secondary tube plate unsecured to the shell of the heat exchanger.

2. A heat exchanger according to claim 1, wherein the main tube plate is formed with a through passage which terminates at the space between the normal and secondary tube plates to allow connection of said space to means for monitoring for leakage.

3. A heat exchanger according to claim 1, wherein the joints between the tubes and the normal tube plate are explosive welds.

4. A heat exchanger according to claims 1, wherein the joints between the tubes and the normal tube plate are produced by welding of each tube to a pintle depending from each bore of the tube plate.

5. A heat exchanger according to claim 1, wherein the joints between the tubes and the secondary tube plate are brazed joints, with the provision of pintles provided on the outer surface of the secondary tube plate.

6. A heat exchanger according to claim 3, wherein the joints between the tubes and the secondary tube plate are brazed joints, with the provision of pintles provided on the outer surface of the secondary tube plate.

7. A heat exchanger according to claim 4, wherein the joints between the tubes and the secondary tube plate are brazed joints, with the provision of pintles provided on the outer surface of the secondary tube plate.

8. A heat exchanger according to claim 1 wherein the joints between the tubes and the secondary tube plate are brazed joints.

9. A heat exchanger according to claim 3 wherein the joints between the tubes and the secondary tube plate are brazed joints.

10. A heat exchanger according to claim 4 wherein the joints between the tubes and the secondary tube plate are brazed joints.

11. A tube-in-shell heat exchanger with double sealing joints between the tubes and a tube sheet, comprising a secondary tube sheet within the shell and adjacent to but spaced from the normal tube sheet, said secondary tube sheet being a substantially rigid member of generally plate form, each tube extending through the secondary tube sheet and being sealingly secured thereto as well as being sealingly secured to the normal tube sheet, and the secondary tube sheet being held and sealed in its spaced position by a bellows sealingly secured to both the normal and the secondary tube sheets and disposed so as to envelope the said tubes, with the secondary tube sheet unsecured to the shell of the heat exchanger, said secondary tube sheet being relatively thick and rigid compared with the relatively thin and flexible material of the bellows.

12. In a tube-in-shell heat exchanger having a casing closed at its ends by main tube plates to define a shell through which a first heat exchange fluid is conducted for contact with the exterior of heat exchanger tubes extending through the shell and the main tube plates and sealingly secured to the main tube plates for conducting another heat exchange fluid through the heat exchanger, the improvement comprising at least one secondary tube plate within the shell and adjacent to but spaced from at least one of said main tube plates, each tube extending through the secondary tube plate and being sealingly secured thereto as well as being sealingly secured to the main tube plate, the secondary tube plate being sealed in its spaced position by a bellows sealingly secured to both the main and the secondary tube plates and disposed so as to envelope the said tubes, with the secondary tube plate unsecured to the shell of the heat exchanger, said bellows being of substantially thinner and more flexible construction than either of said main and secondary tube plates.

* * * * *